US005153643A

United States Patent [19]

Nagakura

[11] Patent Number: 5,153,643

[45] Date of Patent: Oct. 6, 1992

[54] METHOD OF PREVENTING LEAKAGE OF TONER DURING PRE-MOUNTING TRANSPORTATION OF A NEW DEVELOPING UNIT

[75] Inventor: Masanao Nagakura, Kawasaki, Japan

[73] Assignee: Fujitsu Limited, Kanagawa, Japan

[21] Appl. No.: 381,394

[22] PCT Filed: Feb. 9, 1989

[86] PCT No.: PCT/JP89/00131

§ 371 Date: Jul. 6, 1989

§ 102(e) Date: Jul. 6, 1989

[87] PCT Pub. No.: WO89/07788

PCT Pub. Date: Aug. 24, 1989

[30] Foreign Application Priority Data

Feb. 13, 1988 [JP] Japan ..... 63-030038

[51] Int. Cl.[5] ..... G03G 21/00; G03G 15/06

[52] U.S. Cl. ..... 355/215; 355/260

[58] Field of Search ..... 355/260, 215, 245; 222/DIG. 1

[56] References Cited

U.S. PATENT DOCUMENTS

| | | | |
|---|---|---|---|
| 4,060,105 | 11/1977 | Feldeisen et al. | 222/DIG. 1 X |
| 4,768,055 | 8/1988 | Takamatsu et al. | 355/298 |
| 4,849,791 | 7/1989 | Hagihara et al. | 355/260 X |
| 4,862,210 | 8/1989 | Woolley | 355/260 X |

FOREIGN PATENT DOCUMENTS

| | | | |
|---|---|---|---|
| 0006968 | 1/1985 | Japan | 355/260 |
| 0169858 | 6/1986 | Japan | 355/260 |

*Primary Examiner*—A. T. Grimley
*Assistant Examiner*—Nestor R. Ramirez
*Attorney, Agent, or Firm*—Staas & Halsey

[57] ABSTRACT

The present invention relates to a developing unit for developing a latent image on a medium. This developing unit also provides a device for preventing leakage of toner to the cartridge mounting section provided on a unit in order to prevent leakage of toner during pre-mounting transportation of a new developing unit. The leakage preventing device is a cylindrical member having an opening and has the same shape as the toner cartridge for toner supply.

1 Claim, 8 Drawing Sheets

METHOD OF PREVENTING LEAKAGE OF TONER DURING PRE-MOUNTING TRANSPORTATION OF A NEW DEVELOPING UNIT

BACKGROUND OF THE INVENTION

1. Field of the Invention

The present invention relates to a developing unit providing a toner supply section to mount a toner cartridge for supplying toner and an image forming apparatus utilizing the developing unit.

2. Description of the Related Art

An image forming apparatus such as a duplicator or a printer utilizing toner of the electrophotographic system and electrostatic recording system provides a developing apparatus comprising a developing means which supplies toner on a medium and develops an electrostatic latent image formed on the medium and a developing chamber accommodating such developing means and toner to be supplied to the medium from the developing means.

Since the toner in the developing chamber is gradually reduced after use, this developing apparatus is also provided with a cartridge mounting section on which the cartridge accommodating toner therein is mounted the toner is supplied to the developing chamber via this cartridge.

Recently, in view of facilitating maintenance and replacing work of the developing apparatus (particularly, the carrier which has passed its life is considered as the object, in case 2-element developer consisting of toner and carrier is used), the developing apparatus as a whole is formed as a unit, as is described in the official gazette of the Japanese Patent Laid-Open No. 62-17763, for example. Thereby it can be mounted/dismounted to from the image forming apparatus.

However, such developing unit has been accompanied by a problem that the toner spills from the when the cartridge mounting section is opened due to vibration during transportation since transportation is carried out while the toner is accommodated within the developing chamber.

SUMMARY OF THE INVENTION

With the problem described above, it is therefore an object of the present invention to provide a developing unit which does not permit spill of toner from the opening of the cartridge mounting section even if vibration is applied to the developing unit during transportation.

Moreover, it is another object of the present invention to provide an image forming apparatus which allows transportation of toner while it is enclosed within the developing unit and thereby facilitates mounting of the developing unit thereto.

In order to attain the object described above, the present invention constitutes a developing unit for developing a latent image on a medium, comprising a developing means which supplies toner on a medium to develop latent image, a developing chamber accommodating the developing means and toner, a toner case for encasing toner to be supplied to the developing chamber, a developing toner supply means for supplying the toner to the developing chamber from the toner case, a cartridge mounting section for allowing mounting of cartridge accommodating the toner therein to supply the toner to the toner case and a preventing means which is mounted to the cartridge mounting section during transportation of the developing unit to prevent leakage of toner in the developing chamber to the outside of developing unit via the cartridge mounting section.

In the constitution described above, the toner is previously encased, before transportation, to the developing chamber of developing unit and a preventing means prepared is mounted to the cartridge mounting section. Under this condition, the preventing means perfectly seals the cartridge mounting section and thereby prevents entrance of humidity into the interior. Therefore, solidification of toner in the developing unit can be prevented. The developing unit is transported under this condition, but the toner overflowing the developing chamber to the area near the cartridge mounting port (mounting port of preventing means; during the transportation is stopped to from spilling by the preventing means mounted to the cartridge mounting section. Thus it can no longer leak to the outside of unit.

Moreover, as this preventing means, a cylindrical member having an opening is preferred. The circumferential position of cylindrical member is determined so that the opening is located at the lower side. Thereby, the overflowing developer enters the cylindrical member passing through the opening. Accordingly, if the preventing means does not perfectly close the cartridge mounting section, namely even if a certain insertion gap exists between the cylindrical member and cartridge mounting section, leak of toner to the outside can be prevented. Here, the toner collected in the cylindrical member is generally supplied to the developing chamber by the toner supply means during operation.

An embodiment of the present invention will be described hereunder in detail with reference to the accompanying drawings.

Figure 1:
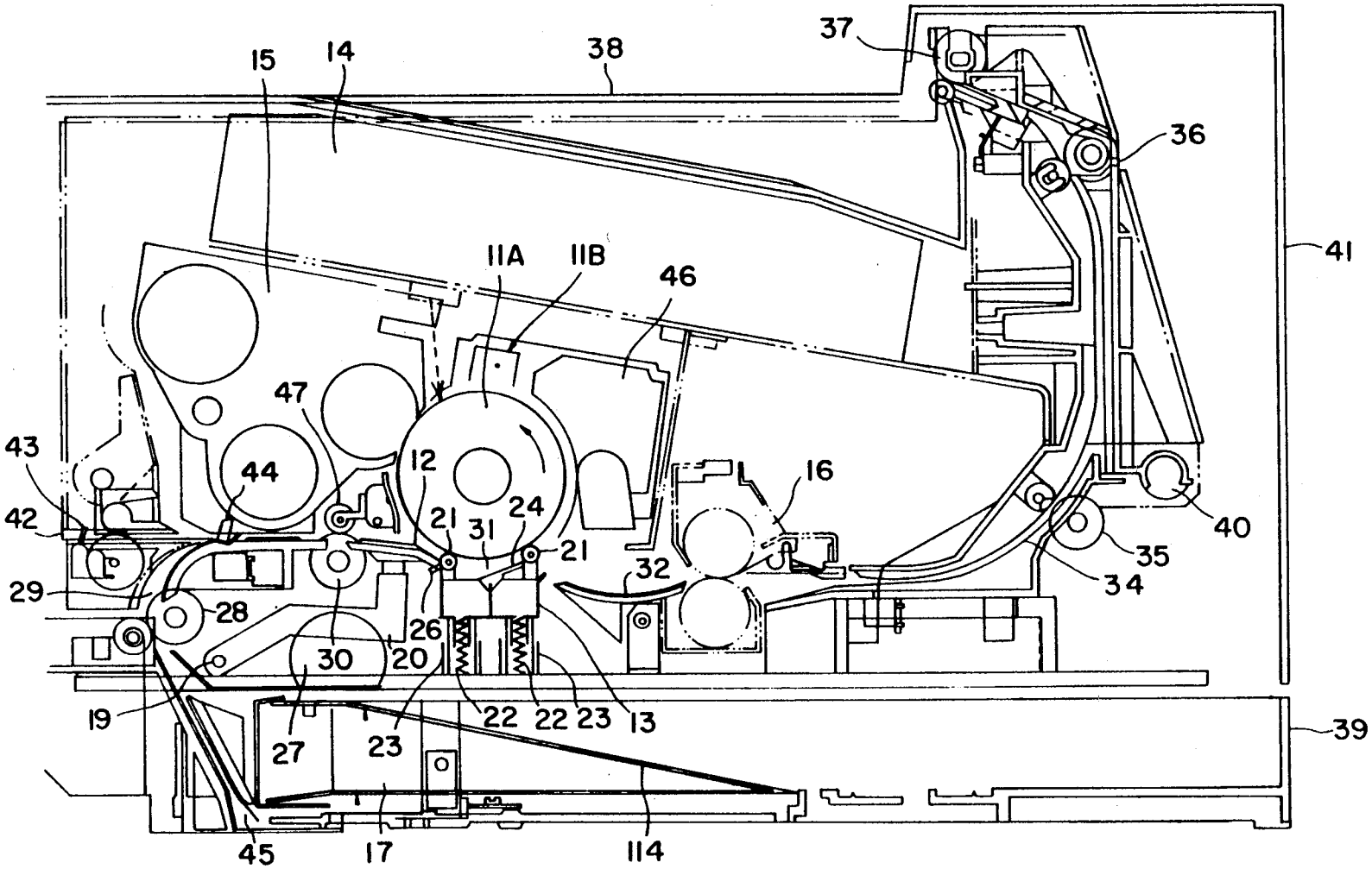
FIG. 1 is a cut-away side elevational view of an electrophotographic recording apparatus according to the present invention simplified for illustrative purpose.

FIG. 1 illustrates a constitution of an electrophotographic recording apparatus.

In this figure, a photosensitive drum 11A is rotatably driven by a rotating motor (not illustrated) using a belt transmission mechanism to form an image with process members such as a precharger, an exposure optical system, a developing unit, a transcription unit and a cleaner. A precharger 11B uniformly charges the entire part of photosensitive drum 11A. A laser optical unit 14 forms an electrostatic latent image on the photosensitive drum 11A by utilizing a semiconductor laser, a rotatable polygon mirror and a f-0 lens and driving the semiconductor laser depending on the information to be recorded. A developing unit 15 is removably provided, as described later, and develops an electrostatic latent image on the photosensitive drum 11A with the toner. A transcription unit 13, comprising a transcription charger in the left side in FIG. 1 and an AC separator in the right side, is energized in the direction of photosensitive drum 11A with a spring 22 and a guide member 23. Two pairs of rollers 21 are in contact pressure with a non image forming region of the photosensitive drum 11A in order to transcript a toner image on the photosensitive drum 11A to a cut sheet type recording paper transferred. A fixing unit 16 is provided with a thermo roller and a pressurizing roller in order to permanently fix the toner image on the recording paper.

A sheet cassette 17 is provided with a supporting plate 114 on which many sheets of cut sheet type recording papers for transcription of toner image are stacked. A spring biases upwardly the supporting plate 114 and a slit 45 for permits passage of papers fed from another cassette (not illustrated). The cassette and arranged at the lower stage thereof, and is mounted removably in the left side in the figure. A pick roller 27 is provided for feeding papers within the sheet cassette 17; a feed roller 28 for transferring supplied paper through a transfer route 29; a standby roller 30 for permitting a pinch roller 47 provided in the photosensitive drum unit (comprising the precharger 11B, cleaner 46 and photosensitive drum 11A) to be in contact with pressure therewith and sends papers to the transcription part 31 by being rotatably and synchronously driven by rotation of the photosensitive drum 11A.

A pretranscription sheet guide 12 is provided for guiding a paper having passed the standby roller 30 to the transcription part 31. This sheet guide is mounted to an arm 20 rotatable around a shaft 19 and can be located to the desired position by being in contact with a stopper 26, by its own weight, provided on the transcription unit 13.

A sheet guide 32 is provided for guiding papers after image transcription to the fixing unit 16. The paper having an image fixed thereon by the fixing unit 16 is guided and transferred along the sheet guide 34 by the transfer rollers 35, 36, 37 and finally ejected on an exhaust stacker 38.

Figure 2:
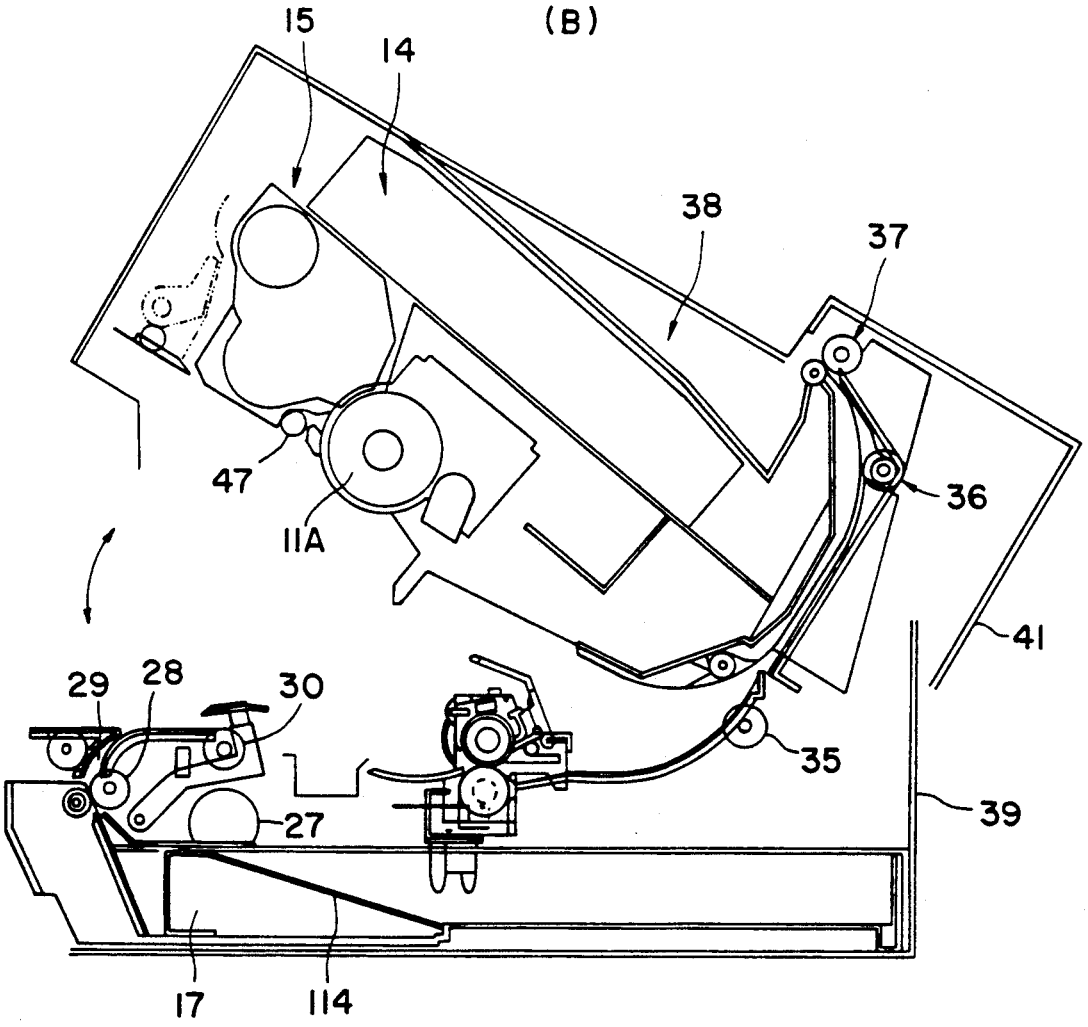
FIG. 2 is the same view as FIG. 1 showing an upper frame in an open position.

Moreover, as shown in FIG. 2, the upper frame 41 of the frames divided into the upper and lower frames on the paper transfer route is provided rotatably around the shaft 40 provided to the lower frame 39. Paper transfer detection sensors 43 and 44 are provided near a manual paper inserting port 42.

A cleaner 46 consisting, for example, of a fur brush remove the toner remaining on the photosensitive drum 11A.

Figure 3:
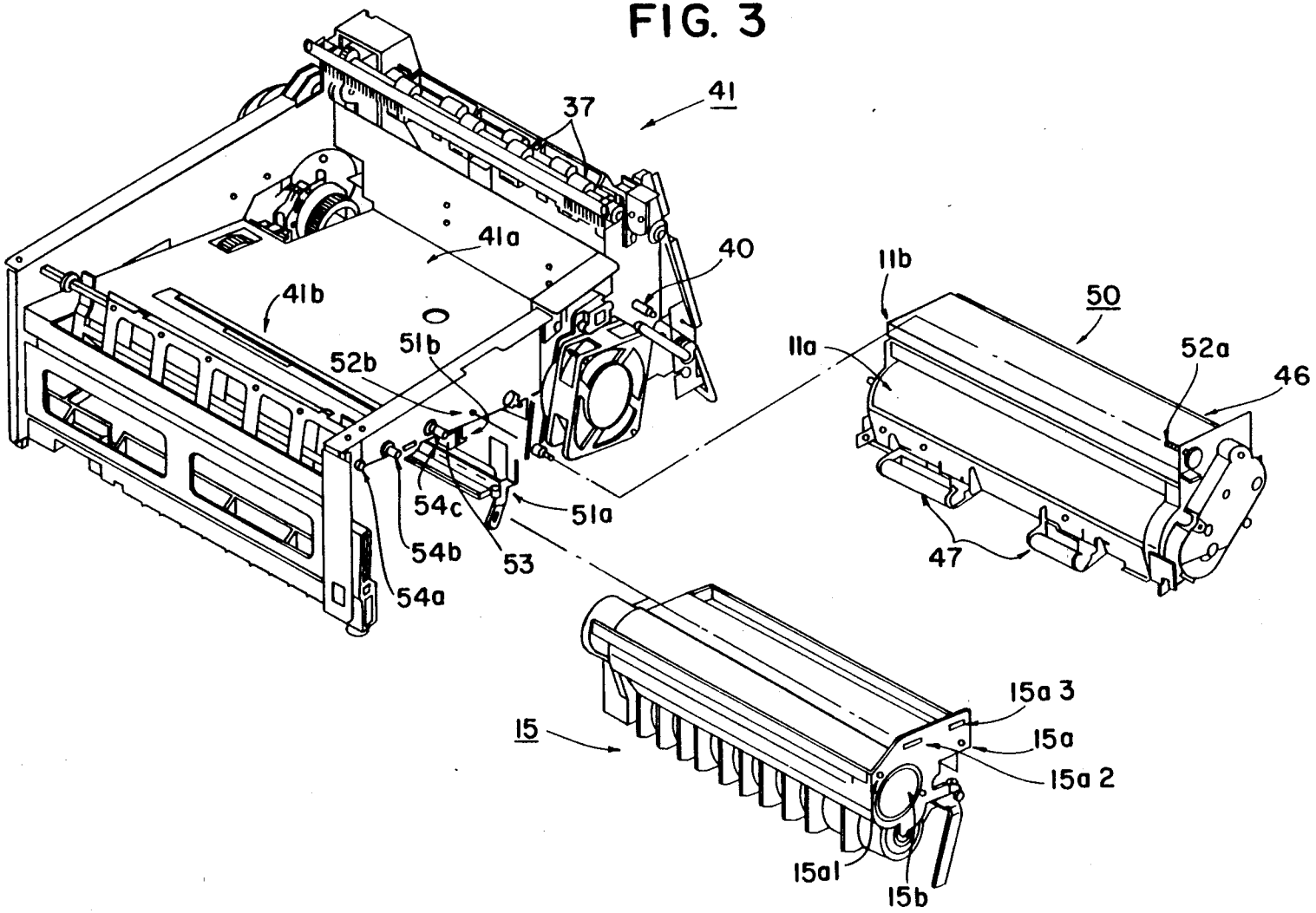
FIG. 3 is an exploded view of the upper frame showing more detail.

The upper frame 41 is provided, removably in the axial direction of the photosensitive drum 11A, with a photosensitive drum unit 50, as shown in FIG. 3, which includes a photosensitive drum 11A, a cleaner 46, a precharger 11B and a pinch roller 47.

The photosensitive drum unit 50 is mounted to the upper frame 41 or can be removed therefrom by being guided along the guide rails 51*a*, 51*b*.

In addition, after the photosensitive drum 50 is mounted to the upper frame 41, it can be fixed thereto by securing a screw 52*a* in a threaded hole 52*b*.

On the other hand, the developing unit 15 can also be removably mounted to the upper frame 41 by being guided into the upper frame 41 along guide rail 53.

This removing operation is carried out when the carrier of the double-element developer consisting of the carrier and toner enclosed within the developing unit 15 reaches its life expectancy.

After the developing unit 15 is mounted, the guide holes 15*a*1, 15*a*2, 15*a*3 bored in a side plate 15*a* of the developing unit 15 are fitted on the guide pins 54*a*, 54*b*, 54*c* provided in the side of the upper frame 41 for positioning. The relative positioning of shaft-to-shaft distance between the photosensitive drum 11A and magnet roller in the developing unit 15 is carried out by mutually setting in contact rotatable disks respectively provided to the shafts of a gear fitted to a drive shaft for driving the photosensitive drum 11A and a gear for rotating magnet roller in the developing unit 15.

A toner is also supplied to this developing unit 15 by mounting a toner catridge of the well known constitution to the toner cartridge case 15*b* from the opening thereof under the condition that the developing unit 15 is attached to the upper frame 41.

In FIG. 3, a laser optical unit 14 is not illustrated and this unit 14 is mounted to the mounting are 41*a* of upper frame 41. Accordingly, the photosensitive drum 11A is irradiated with the laser beam through the opening 41*b* provided to the upper frame 41.

Figure 4:
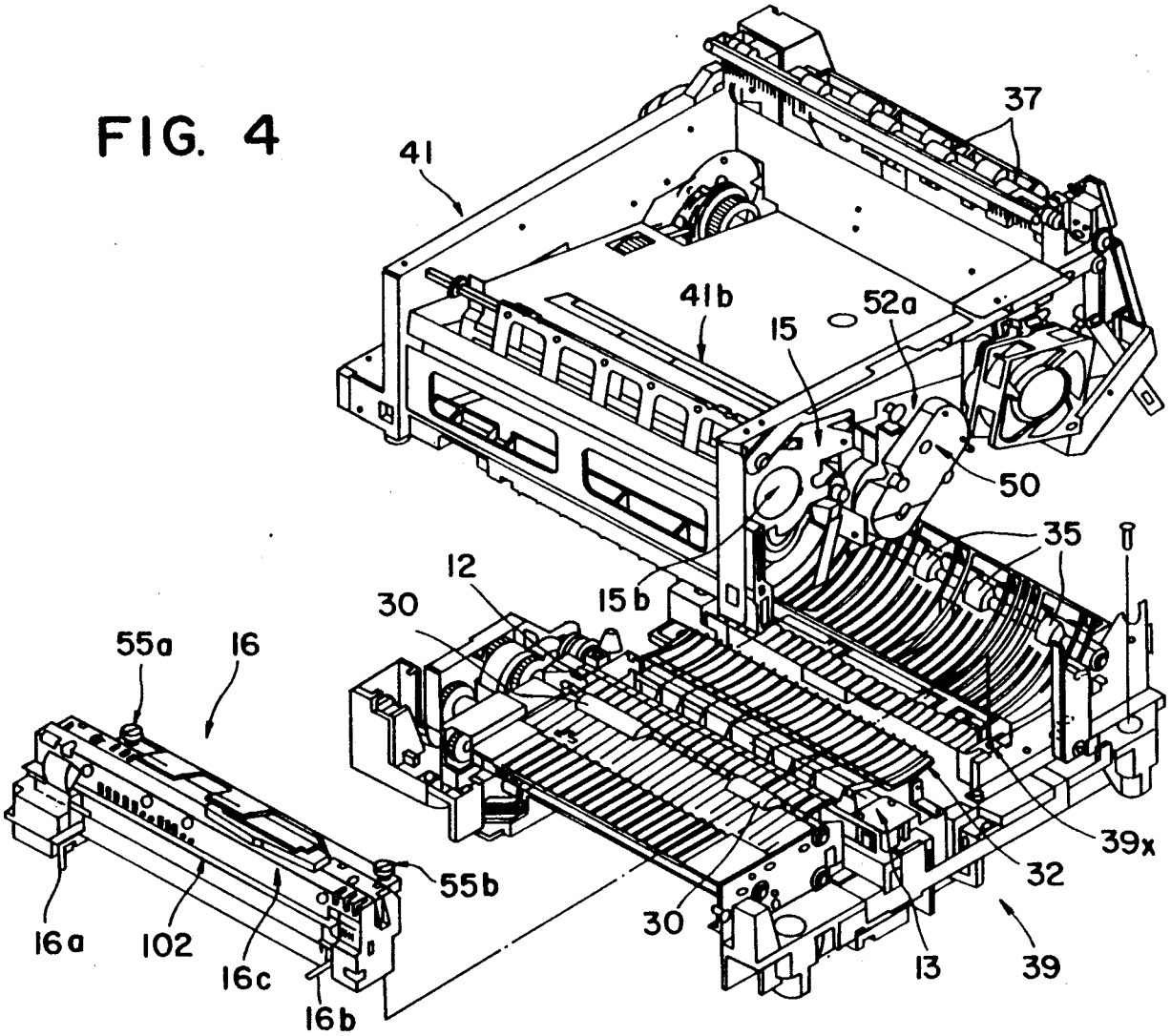
FIG. 4 is a perspective view showing the relationship between the upper frame and a lower frame.

On the other hand, this upper frame 41 is provided opposed to the lower frame 39 as shown in FIG. 4. The pinch roller 47, photosensitive drum 11A, pinch roller 35 pressurized in contact with the transfer roller 35 and a protruded part 15*b* provided at the bottom part of developing unit 15 form the upper transfer section. The standby roller 30, pretransfer sheet guide 12, sheet guide 32 and transfer roller 35 form the lower transfer section.

In FIG. 4, the photosensitive drum unit and developing unit 15 are mounted on the upper frame 41. The toner cartridge can be mounted to the toner cartridge case 15*b* and removed therefrom under this condition.

Moreover, the fixing unit 16 is removably mounted to the lower frame 39. Namely, the fixing unit 16 is positioned to the lower frame 39 with the guide pins 16*a*, 16*b*. A couple of screws 55*a*, 55*b* provided to the fixing unit 16 engage the screw hole 39*x* (only one visible) of the lower frame 39 and thereby the fixing unit 16 may be tightened to the lower frame 39.

Figure 5:
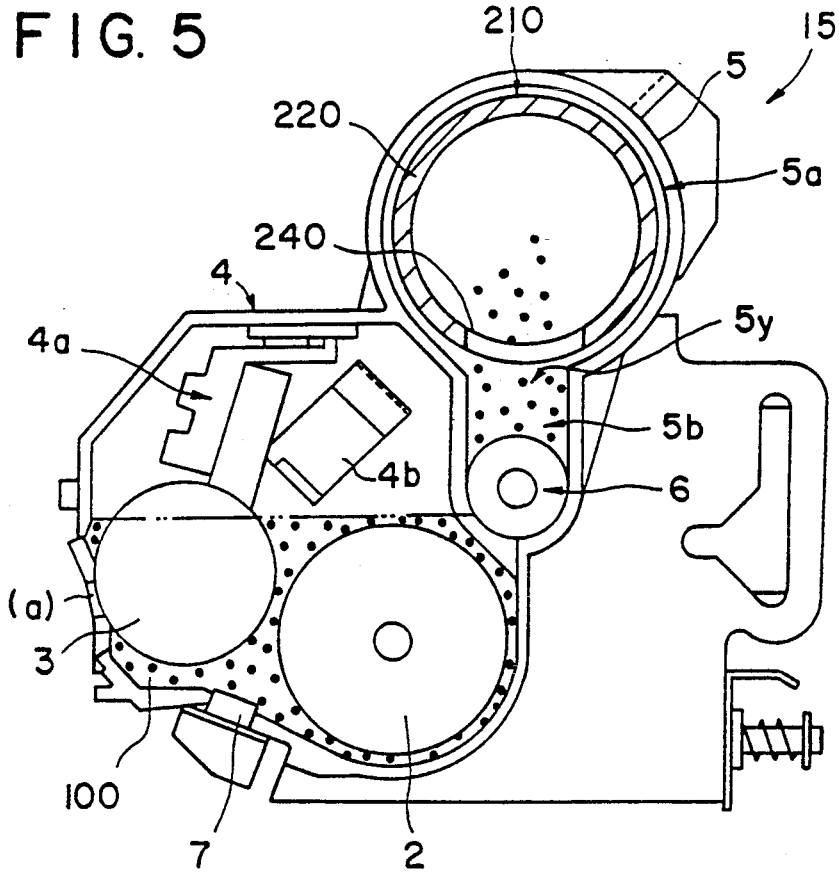
FIG. 5 is a side elevational view showing details of a developing unit.

FIG. 5 illustrates a constitution of the developing unit described above.

In this figure, a developing roller 3 is constituted by a stationarily arranged magnet roller and a rotatable outer cylindrical sleeve made of nonmagnetic material. With rotation of this sleeve, a magnetic brush is formed by toner and carrier and an electrostatic latent image formed on the photosensitive drum 11A provided opposite to the magnetic brush can be developed. The double-element developer 100 is composed of toner and carrier and is encased within the developing tank 4 together with the developing roller 3.

At the bottom of developing tank 4, a toner concentration sensor 7 is provided to measure the concentration of toner for the carrier.

The developing tank 4 also includes a flow restriction plate 4*b* which restricts the flow of the double-element developer 100 restricted by the blades 4*a*, 4*b* to restrict the height of the magnetic brush formed by the developing roller 3 only to the one direction along the width of the photosensitive drum 11A. A screw-shaped stirring roller 2 sends the double-element developer 100 in the developing tank 4 in the reverse direction to the flowing direction at the flow restriction plate 4b so that the toner supplied from the toner supply roller (described later) and the double-element developer 100 falling from the flow restriction plate 4b can be stirred.

The toner supply section 5 is provided integrally with the developing tank 4 and also comprises a cartridge mounting section 5a on which the toner cartridge (described later) is mounted and a toner case 5b in which the toner supplied from the toner cartridge mounted on the cartridge mounting section 5a is reserved. Moreover, near a wall of to the developing tank 4 at a lower part of the toner supply section 5, is provided a toner supply roller 6 made of a sponge material roller to supplies the toner in the toner case 5b to the developing tank 4. This toner supply roller 6 is intermittently driven (the driving system is not illustrated and rotated depending on the toner concentration detected by concentration sensor 7 provided at the bottom of the developing tank 4.

This developing unit 15 is arranged in a predetermined position within the electrophotographic recording apparatus to develop the electrostatic latent image on the photosensitive drum. For developing, the stirring roller 2 and the developing roller 3 are rotated. Thereby, the double-element developer 100 in the developing tank 4 is supplied to the developing roller 3 by the stirring roller 2. The developer on the developing roller 3 is carried to the developing position (a through restriction of height by the doctor blade 4a for the development therein. When the development advances and toner concentration of double-element developer 100 is lowered to a specified value, it is detected by the concentration sensor 7 to rotate the toner supply roller 6. Thereby, the toner in the toner supply section 5 is supplied to the developing tank 4 by the toner supply roller 6 for adjustment of concentration. When the toner supply section 5 becomes empty, the sensor (not illustrated) detects this condition, indicating that the toner must be supplied. In this case, toner can be supplied as explained hereunder.

Figure 6:
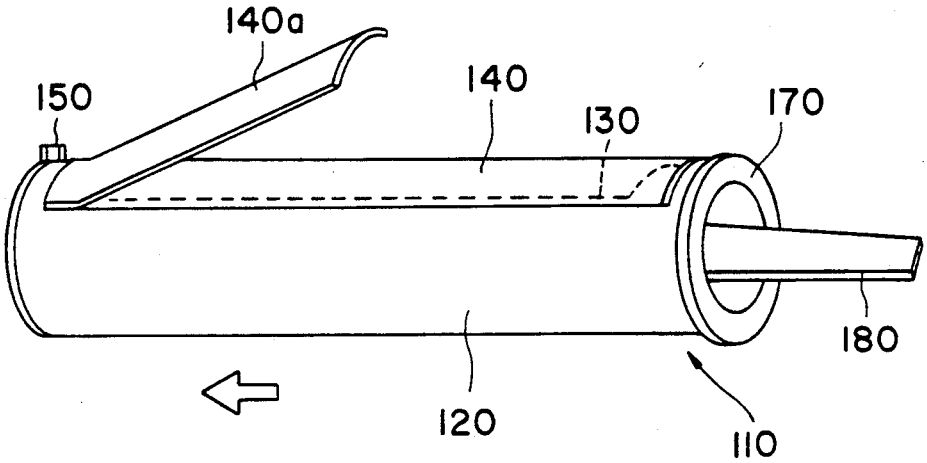
FIG. 6 is a perspective view of a toner cartridge capable of being used in the recording apparatus of the present invention.
Figure 7:
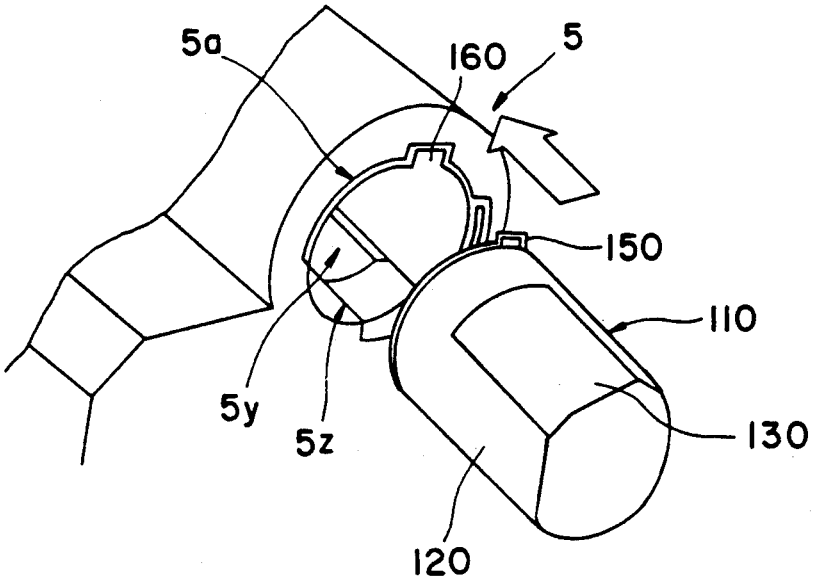
FIG. 7 is a perspective view indicating cartridge insertion procedures for a cartridge mounting section of the developing unit.

Supply of toner may be done using a well known toner cartridge as shown in FIG. 6. This toner cartridge 110 is for example disclosed in the official gazette of Japanese Device Application No. 62-41325. Namely, the toner is encased within a cylindrical body 120 of toner cartridge 110. An opening 130 formed along the cylindrical body 120 is closed by a sealing member 140. To supply toner, the opening 130 is placed in the upper side and the toner cartridge 110 is inserted through the opening 5Z of toner supply section 5 while removing the sealing member 140. In this case, as shown in FIG. 7, a tab 150 is provided at the end part of the cylindrical body 120 adjacent the opening 130. A slot 160 corresponding to a tab 150 is also provided at the region near the inlet of the toner supply section 5. In addition, the tab 150 is inserted while engaging the slot 160. Thereby, the opening 130 can readily be placed on the upper side. Moreover, removing of sealing member 140 can be done easily, as shown in FIG. 6, by bending the sealing member 140 and inserting the cartridge 110 while pulling the end 140a of the sealing member 140.

Upon insertion of cartridge 110, the cylindrical body 120 is rotated for 180° by operating a handle 180 of the flange 170 provided at the end of the cylindrical body 12. Thereby, the toner in the cartridge drops from the opening 130 and is supplied to the toner case 5b through a connecting port 5y connecting the cartridge mounting section 5a and the toner case 5b.

Here, as described previously, supply of toner by the toner cartridge 110 is repeated for several times. And when the carrier or other element reaches its life expectancy, the developing unit 15 is replaced.

This developing unit 15 is transported as described hereunder. That is, as shown in FIG. 5, the toner and carrier are sealed within the developing tank 4 of developing unit 15. Meanwhile, the cylindrical member 210 is set to the cartridge mounting section 5a.

Figure 8:
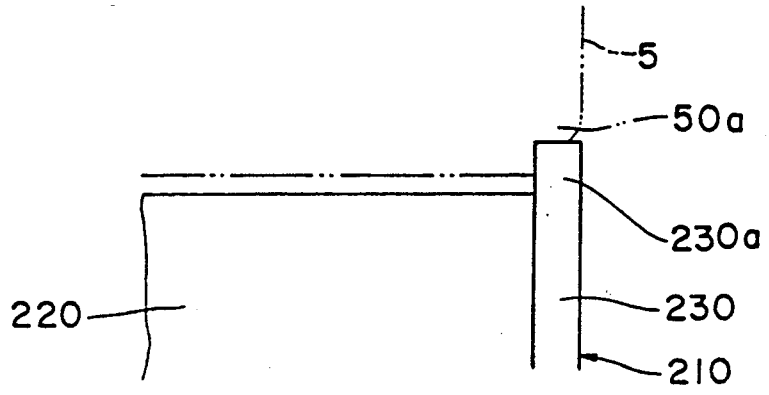
FIG. 8 illustrates a mounting condition of a cylindrical member according to the present invention.

The cylindrical member 210 is constituted integrally with a side plate 230 with the flange, as shown in FIG. 8, at the one end of a cylindrical body 220 engaging with the cartridge mounting section 5a of the toner supply section 5. An opening 240 is formed in the cylindrical body 220.

The application procedures of cylindrical member 210 are as follow.

The cylindrical member 210 can directly use the cartridge 110 which does not seal the toner therein and is not provided with the sealing member 140.

The cylindrical member 210 is not always required to be in the same size and shape as the toner cartridge 110 and it is enough when it can cover the hollow section and connecting inlet 5y and has the opening 240 which allows passage of toner sent from the toner case 5b.

In the developing unit, the toner and carrier which are constituents of the double-element developer 100 are encased within the tank 4 before transportation. The prepared cylindrical member 210 is mounted to the cartridge mounting section 5a of the toner supply section 5. In this case, the position in the circumferential direction of cylindrical member 210 is set so that the opening 240 is located in the lower side. When the cylindrical member is mounted, as shown in FIG. 8, the flange 230a of side plate 230 engages with the circumference of the of toner cartridge mounting port 50a of toner supply section 5 to seal this area.

Figure 9A:
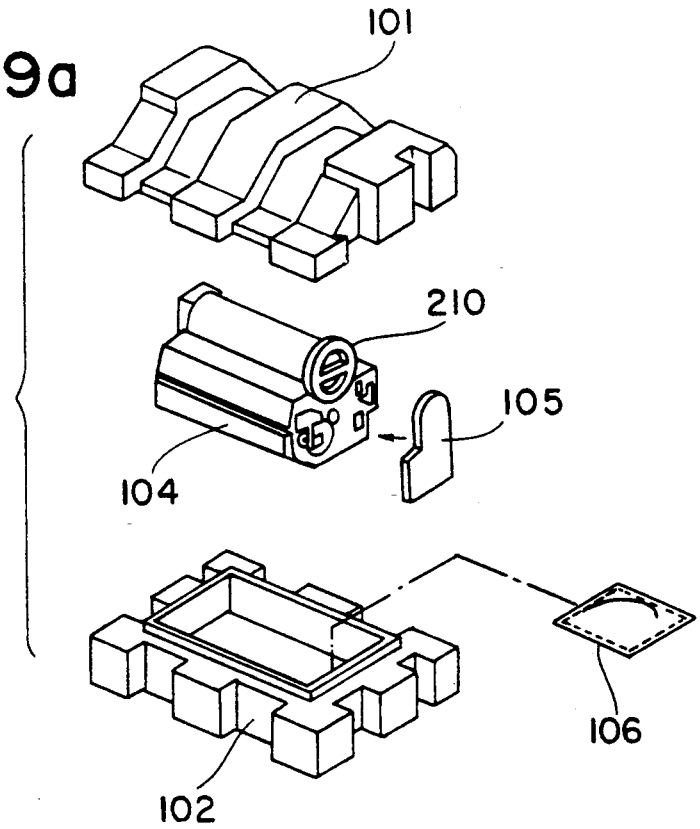
FIG. 9(*a*) is an exploded view illustrating packing procedures of the developing unit while FIG. 9(*b*) is a perspective view of the assembled packing material.
Figure 9B:
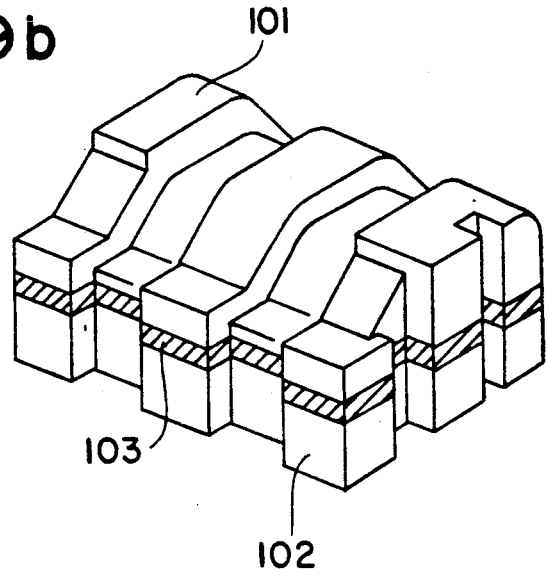

Under this condition, as shown in FIG. 9, the developing unit 15 is housed within the upper and lower styrene cases 101, 102 and the joint of both cases 101, 102 is sealed with a vinyl tape 103 for the packing. In this case, the exposed area of developing roller 3 and side surface of unit are held by the packings 104 and 105. Desiccating agent 106 is put into both cases 101, 102. Under this condition, the toner supply section 5 is perfectly sealed to prevent entry of humidity.

Transportation of the unit is carried out under this condition but the developer 100 overflowing to the toner case 5b passing through the gap, during the transportation, between the toner case 5b and toner supply roller 6 from the developing tank 4 is stopped by the cylindrical member 210 mounted to the cartridge mounting section 5a and cannot leak to the outside. Since the opening 240 is provided at the lower side of cylindrical member 210, the overflowing developer is collected within the cylindrical member 210 passing through this opening 240. In case the developing unit 15 is to be stored after completion of transportation, the developer 100 in the cylindrical member 210 drops into the toner case 5b.

The developing unit 15 transported and stored as described above can be mounted to the recording apparatus by unpacking and then mounting it to the specified position of the apparatus. While the cylindrical member 210 is mounted, operation can be started. Thereby, the toner in the toner case 5*b* can gradually be returned to the developing tank 4 by the toner supply roller 6. Even if a part of the developer 100 is remained within the cylindrical member 210 at the time of mounting, the developer 100 drop due to the vibration during the operation thereof and finally returns perfectly to the developing tank 4.

After continuation in operation of the apparatus, when concentration of toner is lowered, supply of toner is required as described. In this case, the cylindrical member 210 is removed and the toner cartridge is mounted in the procedures described above for supply of toner.

Figure 10:
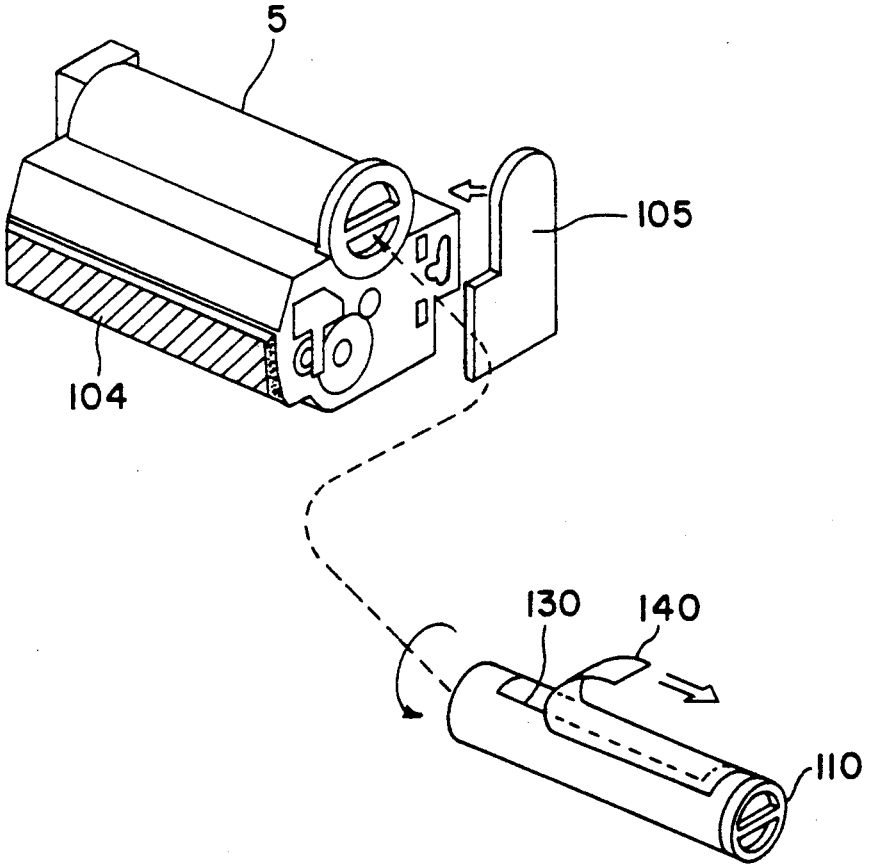
FIG. 10 is a perspective view indicating mounting procedures of the other cylindrical member.

In above explanation, a particularly designed cylindrical member is used as an example, but the toner cartridge can also be used as the cylindrical member. In this case, it is enough, as shown in FIG. 10, that an empty toner cartridge 110 from which the toner is removed by removing the sealing member 140 is mounted to the cartridge mounting section 5 as indicated by the arrow mark of dotted line with the opening 130 placed in the lower side.

Thereafter, as described above, the unit is packed using the packing materials 104, 105 for the purpose of transportation.

I claim:

1. A method of preventing toner leakage during premounting transportation of a new developing unit having a toner cartridge mounting portion, an empty toner case in communication with the toner cartridge mounting portion, a developing tank having a supply of toner encased therein prior to transportation, and a toner supply mechanism disposed between the developing tank and the toner case, the method comprising the step of:

placing a hollow cylindrical member having an opening in the toner cartridge mounting portion; and positioning the opening opposed to a connecting section provided between the toner cartridge mounting portion and the toner case so that toner from the developing tank enters the hollow cylindrical member and is thus prevented from leaking during transportation.

* * * * *

UNITED STATES PATENT AND TRADEMARK OFFICE

CERTIFICATE OF CORRECTION

PATENT NO. : 5,153,643

DATED : October 6, 1992

INVENTOR(S) : MASANAO NAGAKURA

It is certified that error appears in the above-identified patent and that said Letters Patent is hereby corrected as shown below:

Col. 1, line 36, "to" should be --to/--.

Col. 1, line 39, delete "from the".

Col. 2, line 17, delete "to".

Col. 3, line 26, delete "for".

Col. 3, line 27, replace "and" with --is--.

Col. 3, line 58, after "brush", add a comma, --,--.

Col. 5, line 16, delete "to".

Col. 5, line 18, delete "roller to", and insert --. Roller 6--.

Col. 5, line 21, after "illustrated", add a parenthesis --)--.

UNITED STATES PATENT AND TRADEMARK OFFICE

CERTIFICATE OF CORRECTION

PATENT NO. : 5,153,643

DATED : October 6, 1992

INVENTOR(S) : Masanao Nagakura

It is certified that error appears in the above-indentified patent and that said Letters Patent is hereby corrected as shown below:

Col. 5, line 33, after "(a", add a parenthesis --)--.

Signed and Sealed this

Eighteenth Day of January, 1994

*Attest:*

Bruce Lehman

BRUCE LEHMAN

*Attesting Officer*

*Commissioner of Patents and Trademarks*